United States Patent [19]

Pascal et al.

[11] Patent Number: 4,657,279

[45] Date of Patent: Apr. 14, 1987

[54] ANTI-FRICTION DEVICE FOR SKI BINDING

[75] Inventors: Roger Pascal, Annecy-Le-Vieux; Denis Girault, Annecy, both of France

[73] Assignee: Salomon S.A., Annecy, France

[21] Appl. No.: 816,377

[22] Filed: Jan. 6, 1986

Related U.S. Application Data

[63] Continuation of Ser. No. 538,897, Oct. 4, 1983, abandoned.

[30] Foreign Application Priority Data

Oct. 4, 1982 [FR] France ..... 82 17014

[51] Int. Cl.[4] ..... A63C 9/00

[52] U.S. Cl. ..... 280/636; 428/421; 524/546

[58] Field of Search ..... 280/636; 524/546; 428/421, 422

[56] References Cited

U.S. PATENT DOCUMENTS

| | | | |
|---|---|---|---|
| 3,618,965 | 11/1971 | Hecker | 280/636 |
| 3,647,234 | 3/1972 | Gertsch et al. | 280/636 |
| 3,806,144 | 4/1974 | Yano et al. | 280/636 |
| 3,814,454 | 6/1974 | Begl | 280/636 |
| 4,115,619 | 9/1978 | Kurfman et al. | 428/422 |
| 4,133,798 | 1/1979 | Nishimura et al. | 526/1 |
| 4,255,481 | 3/1981 | Dinella et al. | 428/422 |
| 4,310,588 | 1/1982 | Bareel | 428/421 |
| 4,444,826 | 4/1984 | Sasaki et al. | 428/422 |

FOREIGN PATENT DOCUMENTS

| | | | |
|---|---|---|---|
| 2129391 | 12/1971 | Fed. Rep. of Germany | 280/636 |
| 3005761 | 9/1980 | Fed. Rep. of Germany | 280/636 |
| 2128012 | 10/1972 | France | 280/636 |
| 2150314 | 4/1973 | France | 428/422 |

OTHER PUBLICATIONS

Teflon, E.I. DuPont & Co., 1957, pp. 28–29.

*Primary Examiner*—Nancy Swisher
*Attorney, Agent, or Firm*—Sandler & Greenblum

[57] ABSTRACT

Anti-friction plate for use on a ski or ski binding. The anti-friction plate has a surface to be adhesively secured and means for shielding the surface of the plate from solar radiation.

10 Claims, 5 Drawing Figures

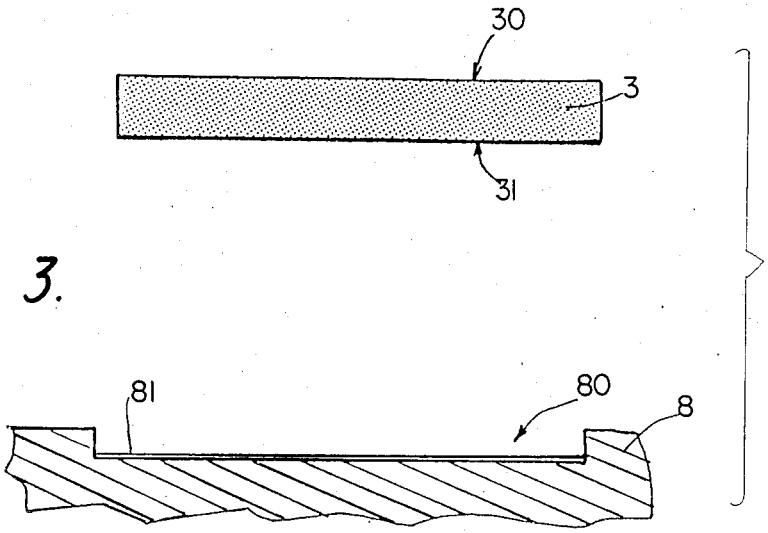
FIG. 3.
FIG. 4.
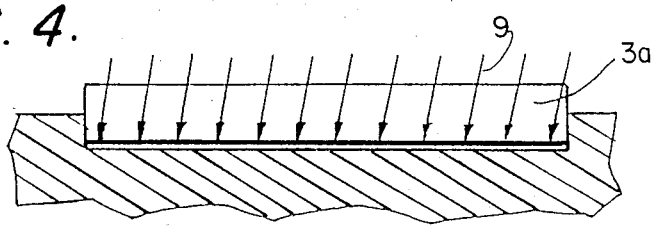
FIG. 5.
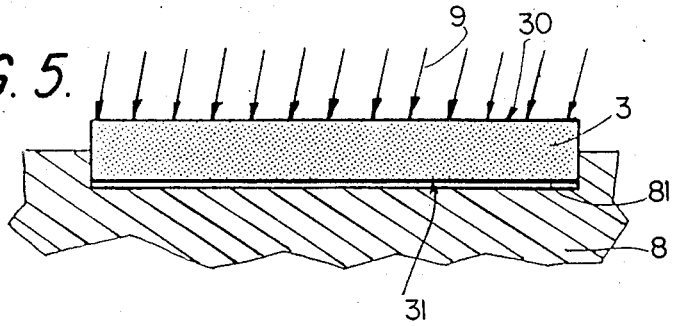

ANTI-FRICTION DEVICE FOR SKI BINDING

This is a continuation of application Ser. No. 538,897 filed Oct. 4, 1983, abandoned.

BACKGROUND OF THE INVENTION

1. Field of the Invention

The present invention relates to an anti-friction article adapted for use in combination with a ski binding, and more particularly to an apparatus in the form of a plate adapted to support the sole of a ski boot.

2. Description of Prior Art

In skiing, the ski boot is bound to the ski in a manner so as to be freed or released when the boot is subjected to forces exceeding a certain intensity by means of ski bindings which maintain this boot. During release or freeing of the boot there is friction between the sole and, the jaw of the binding and the ski on which the boot rests. The frictional forces are resistance forces which resist displacement of the boot. Thus, to obtain a release force which is as constant as possible it is necessary to minimize and control these forces. Furthermore, in the case where the force on the boot is insufficient to cause the rejection of the boot, it is imperative that the binding be allowed to return to the centered position in an accurate, simple and precise manner. Once again the frictional forces are particularly troublesome and must be reduced to the maximum extent possible.

To improve and control the frictional conditions, the most commonly utilized present solution comprises interposing between the ski, or even the jaw and the sole, plate made of a material having a very low coefficient to friction with respect to the material of the ski boot sole. Fluorocarbon resins such as polytetrafluorethylene or ethylenepropyleneflouride are particularly well suited to this purpose. Most often, the plate is glued on. These resins possess an exceptionally low coefficient of friction which they maintain over very broad temperature ranges. However. these materials, by virtue of their non-stick quality, raise a certain number of problems when it becomes a question of gluing these materials to one another or onto a support made of a different material such as aluminum, polyethylene or ABS. For reasons of simplicity of manufacture, the gluing of the plates in a ski binding is achieved either by employing a double surface adhesive, or by the use of a glue of the cyanoacrylate or isocyanate acrylic type. However, in both cases, the surface of the plate which is to be glued, must be subjected to a pretreatment to assure the proper adhesion of the glue. The method of treatment comprises modifying the chemical structure of the surface to be glued in a fashion so as to destroy its non-stick characteristics in the places where pretreatment is performed. Various treatments can be utilized: among which sodium and ammonia, or further the method of sodium and naphthalene, by way of example. Presently, the plates made of polytetrafluoroethylene utilized in bindings are all white. However, white plates made of polytetrafluoroethylene are not without inconvenience because they become unglued after exposure to the sun. This is particularly serious because skiing is most often done in the sun under intense ultraviolet radiation, and the ungluing of the plates. This endangers the proper operation of the binding and can even cause a break of the skiers leg, which of course is exactly the opposite of the aim of the binding itself, which is to provide additional and not reduced safety to the skier.

DESCRIPTION OF PREFERRED EMBODIMENTS

It is, therefore, an object of the invention to provide a technique which prevents solar radiation damage to the plate, wherever it is mounted - either on the ski, the boot, or the binding.

According to one embodiment of the invention an anti-friction plate is provided for use on a ski or ski binding. The plate includes a surface to be adhesively secured and means for shielding the surface of the plate from solar radiation. The means for shielding the surface from solar radiation preferably comprises a substance incorporated into the plate which stops ultraviolet radiation from reaching the surface. The substance may be a coloring material or a material which chemically modifies the chemical structure of the composition of which the plate is formed so as to color the material. The coloring material gives the plate a dark color. Preferably, the plate is colored black, red, blue, green or brown. Rather than altering the color of the plate by using substance which protects the surface by absorbing ultraviolet radiation, a material which reflects damaging radiation away may also be used.

The dark coloring serves to protect the surface which has been pre-treated to improve the adhesive qualities of the surface. The plate itself may be formed of fluorocarbonated resin such as polytetraflouroethylene.

The surface may have been pre-treated using any one of a number of techniques, including sodium and ammonia; and sodium naphthalene.

BRIEF DESCRIPTION OF THE DRAWINGS

The invention will now be described with reference to the description which follows, with reference to the annexed eschematic drawings given by way of nonlimiting example in which:

FIG. 3 is a magnified view illustrating the elements of the anti-friction apparatus according to the invention;

FIG. 4 is a magnified view of a conventional polytetrafluoroethylene anti-friction plate in white, glued onto its support; and FIG. 5 is a magnified view of an anti-friction plate according to the invention, glued within its support.

DETAILED DESCRIPTION OF THE INVENTION

After numerous tests both on the slope as well as in the laboratory, it has now been found that it is the ultraviolet radiation which, in passing through the white plates, destroys the surface pre-treatment on the underneath of the plate, which then results in a partial or even total ungluing of the plate.

The present invention overcomes the disadvantages of the prior art and provides an anti-friction support for a ski binding which comprises an anti-friction plate which is glued onto a support. The plate is made of a fluorocarbonated or other resin which has undergone a surface pretreatment to overcome its non-adherent characteristics and is thus adapted to be glued. According to the invention the plate contains a filler or coloring agent absorbs or reflects the ultraviolet radiation and thus preserves the surface (or portion thereof) which has undergone the surface pre-treatment from all attack by the sun and thus assures a better adhesion of the plate.

According to another aspect of the invention, the filler utilized is a coloring agent which is preferably dark in color, such as black, brown, blue, red or green.

Figure 1:
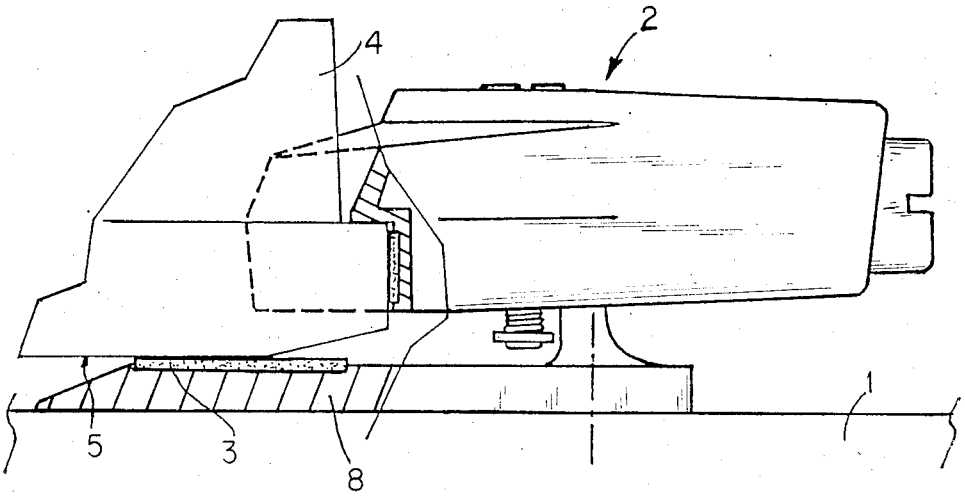
FIG. 1 schematically illustrates a lateral elevational view, partially in axial cross-section, of a ski binding, provided with an anti-friction device according to the invention.
Figure 2:
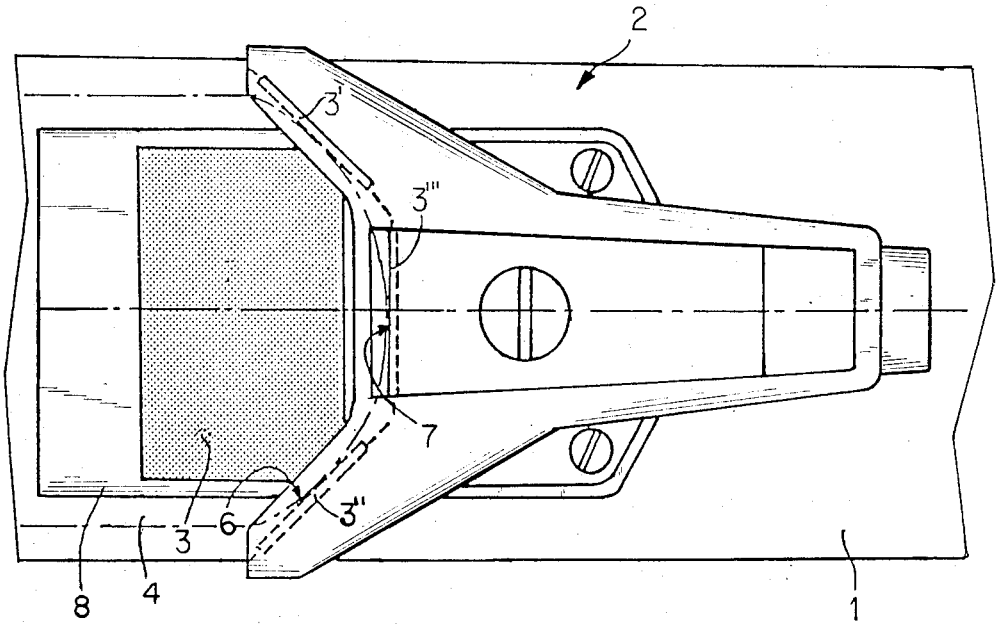
FIG. 2 is a top view of the embodiment illustrated in FIG. 1.

Referring to FIGS. 1 and 2, a ski binding 2 is mounted on a ski 1 which can be of any known type. The binding comprises anit-friction plates 3, 3', 3'', and 3''' on and against which ski boot 4 is adapted to rest when the boot is inserted into the binding and held onto the ski. Plate 3 is positioned under the front of the ski boot and it is the underneath of the sole 5 which presses on its upper surface. Other plates 3', 3'', and 3''' can be positioned in the jaw of the binding as shown. Lateral plates 3' and 3'' cooperate with lateral edges 6 of the ski boot sole while plate 3''' cooperates with frontal portion 7 of the sole. The anti-friction plates are cut out into the form of a sheet or plate having a thickness of approximately 1.5mm and are adapted to be glued onto a support zone. For plate 3, support 8 can be made of ABS (acrylonitrile butadiene styrene), while for plates 3, 3'', 3''', the support being the jaw, can be made of aluminum or DELRIN. On the other hand, the plates are preferably embedded in the manner described in French Pat. No. 2,150,314, the disclosure of which is hereby incorporated by reference. In the description which follows, the plate will be described in a general manner by reference numeral 3, while the support will generally be referenced as 8.

As has been noted above, the anti-friction plates are made of polytetrafluoroethylene (PTFE) because this material has a particularly low coefficient of friction. Plate 3 is generally in the form of a rectangle having a thickness of approximately 1.5 mm and comprises two surfaces 30 and 31 which are parallel (FIG. 3). Upper surface 30 constitutes the surface in contact with the boot and the lower surface 31 is adapted to be glued on corresponding support 8. As was seen above, lower surface 31 has undergone a chemical pre-treatment which need not be further described in detail. Support 8 preferably comprises a seat or cut-out 80 adapted to receive plate 3. Before mounting the plate on its support, glue 81 of the cyanoacrylate-type is positioned on the bottom of the cut-out. It is quite obvious that one does not exceed the scope of the invention if a double-sided adhesive paper is used which would first be adhered under the plate, before mounting on its support.

FIG. 4 illustrates a traditional plate 30*a*, glued on its support while FIG. 5 illustrates a plate 3 according to the invention. Conventional plates 3*a* (FIG. 4), presently utilized are made of white polytetrafluoroethylene whose lower surface is treated for gluing. Also, ultraviolet rays 9, due to solar radiation, penetrate and go through the plates, and the pre-treated surface which improves its gluing ability undergoes a rapid degradation which results in a poor retention ability of the glue with a resultant premature ungluing which is not desirable and which is dangerous for the skier. In effect, the plate or plates can become purely and simply partially or entirely unglued which is even more dangerous because the unglued portion can bend up and hook the sole of the ski boot. The penetration of ultraviolet radiation is due to the white color of traditional plates which allows this to occur. Thus, according to the invention, the resinous material is dosed, charged or loaded with a filler or other coloring agent which is mixed with the polytetrafluoroethylene to resist this solar penetration. FIG. 5 illustrates such an arrangement.

The resin can be dosed simply with a coloring agent and the plate can, therefore, for example, be black, blue, brown, green or red. As seen schematically in FIG. 5, the ultraviolet radiation is stopped and does not go through the plate and the gluing treatment remains perfectly intact such that the skier suffers no danger due to the plate becoming unglued.

Although the invention has been described with reference to a particular resinous anti-friction material, it is to be understood that the fluorocarbonated resin can be modified by the addition of a radical whose addition will act to cause the absorption of ultraviolet rays such as, for example, $(CF_2)n(CR)m$.

Furthermore, although the invention has been described with reference to particular means and embodiments, particular bindings, particular plate materials and glue resins and glue pretreatments, it is to be understood that the invention is not limited to the particulars disclosed but extends to all alternative embodiments falling within the scope of the claims.

We claim:

1. In a polytetrafluorethylene ski binding anti-friction plate of the type pretreated to provide an adhesive receptive surface, the improvement comprising a pigment or filler incorporated into said plate forming a colored plate which pigment or filler serves to reduce the ultra-violet absorption reaching the treated surface whereby damage causing disfunction or delamination of this surface is prevented.

2. The anti-friction plate as defined by claim 1 wherein said pigment material gives the plate a dark color.

3. The anti-friction plate as defined by claim 2 wherein said pigment gives the plate a black, red, blue, green or brown color.

4. The anti-friction plates as defined by claim 1 wherein said plate is formed of fluorocarbonated resin.

5. The anti-friction plate as defined by claim wherein said pigment protects said surface by absorbing ultraviolet radiation.

6. The anti-friction plate as defined by claim 1 wherein said pigment reflects ultraviolet radiation away from said surface.

7. The anti-friction plate as defined by claim 1, said plate being formed of polytetrafluoroethylene.

8. The anti-friction plate as defined by claim 1, wherein said surface has been pretreated with sodium and ammonia.

9. The anti-friction plate as defined by claim 1 wherein said surface has been pretreated with sodium naphthalene.

10. The anti-friction plate as defined by claim 1 adhesively secured to a ski.

* * * * *

UNITED STATES PATENT AND TRADEMARK OFFICE

CERTIFICATE OF CORRECTION

PATENT NO. : 4,657,279

DATED : April 14, 1987

INVENTOR(S) : Roger PASCAL et al.

It is certified that error appears in the above-identified patent and that said Letters Patent is hereby corrected as shown below:

At column 1, line 33, change "plate" to ---plates---.

At column 4, line 30, change "polytetrafluorethylene" to ---polytetrafluoroethylene---.

At column 1, line 19, delete "," after first "and".

At column 2, line 36, change "eschematic" to ---schematic---.

Signed and Sealed this

Eleventh Day of October, 1988

*Attest:*

*Attesting Officer*

DONALD J. QUIGG

*Commissioner of Patents and Trademarks*